US005270773A

United States Patent [19]

Sklut et al.

[11] Patent Number: 5,270,773

[45] Date of Patent: Dec. 14, 1993

[54] IMAGE PRODUCING DEVICE WITH SECURITY TO PREVENT DISCLOSURE OF SENSITIVE DOCUMENTS

[75] Inventors: Robert L. Sklut, Rochester; Thomas Acquaviva, Penfield, both of N.Y.

[73] Assignee: Xerox Corporation, Stamford, Conn.

[21] Appl. No.: 982,357

[22] Filed: Nov. 27, 1992

[51] Int. Cl.[5] ..... G03G 21/00

[52] U.S. Cl. ..... 355/201; 355/206; 355/323

[58] Field of Search ..... 355/200, 201, 202, 206, 355/209, 323, 324

[56] References Cited

U.S. PATENT DOCUMENTS

| | | | |
|---|---|---|---|
| 4,414,579 | 11/1983 | Dattilo et al. . | |
| 4,437,660 | 3/1984 | Tompkins et al. . | |
| 4,470,356 | 9/1984 | Davis et al. . | |
| 4,561,765 | 12/1985 | Masuda | 355/323 |
| 4,655,582 | 4/1987 | Okuda et al. | 355/323 |
| 5,034,770 | 7/1991 | O'Connell | 355/201 |
| 5,045,881 | 9/1991 | Kinder et al. | 355/206 |
| 5,098,074 | 3/1992 | Mandel et al. . | |

FOREIGN PATENT DOCUMENTS

| | | | |
|---|---|---|---|
| 0241273 | 10/1987 | European Pat. Off. . | |
| 140435 | 6/1986 | Japan | 355/201 |
| 131579 | 5/1989 | Japan | 355/201 |

OTHER PUBLICATIONS

Bacon et al, IBM Technical Disclosure Bulletin, vol. 18 No. 6, Nov. 1975, pp. 1747–1748.

Bolle et al., "Access Controlled Copier"; United States Defensive Publication No. T102,102; Aug. 3, 1982.

*Primary Examiner*—Benjamin R. Fuller
*Assistant Examiner*—J. E. Barlow, Jr.
*Attorney, Agent, or Firm*—Oliff & Berridge

[57] ABSTRACT

An image producing device such as a copier or a printer includes sensors for determining the presence of output from a previous job in the paper path or a finishing device. A particular operator's access rights are determined through a login process. Depending on the operator's access level, i.e., authority to view sensitive documents, the image producing device enables a purge of the existing sensitive documents or electronic images or prevents operation until an authorized operator initiates a purge.

23 Claims, 5 Drawing Sheets

| STEP | DESCRIPTION |
|---|---|
| 100 | OPERATOR LOGIN |
| 101 | DISPLAY MENU |
| 102 | SETUP |
| 103 | DOES SETUP REQUIRE USE OF FACILITIES CONTAINING SECURE WASTE FROM A PREVIOUS JOB? |
| 104 | PERFORM JOB |
| 105 | JAM OR MALFUNCTION? |
| 106 | SETUP ANOTHER JOB? |
| 107 | LOGOUT REQUEST |
| 108 | ANY REMAINING WASTE OUTPUT? |
| 109 | LOGOUT |
| 200 | IS AUTOMATIC PURGE AVAILABLE? |
| 201 | DISPLAY MESSAGE "MANUAL JAM CLEARANCE REQUIRED" |
| 202 | CLEAR? |
| 300 | PURGE |
| 500 | DISPLAY MESSAGE "MUST CLEAR BEFORE LOGOUT" |
| 501 | AUTOMATIC PURGE AVAILABLE? |
| 502 | AUTOMATIC PURGE PERFORMED? |
| 503 | RECORD OPERATOR ID |
| 600 | DISPLAY MESSAGE "MANUAL JAM CLEARANCE REQUIRED" |
| 601 | CLEAR? |
| 602 | RECORD OPERATOR ID |
| 700 | CHECK ACCESS LEVEL |
| 701 | IS AUTOMATIC PURGE AVAILABLE? |
| 702 | PURGE - DISPLAY MESSAGE "SECURE WASTE BEING PURGED, PLEASE DISCARD PROPERLY" |
| 703 | IS MANUAL JAM CLEARANCE REQUIRED? |
| 704 | DISPLAY MESSAGE "MANUAL JAM CLEARANCE REQUIRED - SECURE WASTE, PLEASE DISCARD PROPERLY" |
| 705 | CLEAR? |
| 706 | LOGOUT (A) IF (A) IS LOGGED IN |
| 800 | DISPLAY MESSAGE "AUTHORIZED PURGE USER REQUIRED" |
| 801 | LOGIN OF AUTHORIZED OPERATOR (A) |

| STEP | DESCRIPTION |
|---|---|
| 100 | OPERATOR LOGIN |
| 101 | DISPLAY MENU |
| 102 | SETUP |
| 103 | DOES SETUP REQUIRE USE OF FACILITIES CONTAINING SECURE WASTE FROM A PREVIOUS JOB? |
| 104 | PERFORM JOB |
| 105 | JAM OR MALFUNCTION? |
| 106 | SETUP ANOTHER JOB? |
| 107 | LOGOUT REQUEST |
| 108 | ANY REMAINING WASTE OUTPUT? |
| 109 | LOGOUT |
| 200 | IS AUTOMATIC PURGE AVAILABLE? |
| 201 | DISPLAY MESSAGE "MANUAL JAM CLEARANCE REQUIRED" |
| 202 | CLEAR? |
| 300 | PURGE |
| 500 | DISPLAY MESSAGE "MUST CLEAR BEFORE LOGOUT" |

FIG. 3

| | |
|---|---|
| 501 | AUTOMATIC PURGE AVAILABLE? |
| 502 | AUTOMATIC PURGE PERFORMED? |
| 503 | RECORD OPERATOR ID |
| 600 | DISPLAY MESSAGE "MANUAL JAM CLEARANCE REQUIRED" |
| 601 | CLEAR? |
| 602 | RECORD OPERATOR ID |
| 700 | CHECK ACCESS LEVEL |
| 701 | IS AUTOMATIC PURGE AVAILABLE? |
| 702 | PURGE - DISPLAY MESSAGE "SECURE WASTE BEING PURGED, PLEASE DISCARD PROPERLY" |
| 703 | IS MANUAL JAM CLEARANCE REQUIRED? |
| 704 | DISPLAY MESSAGE "MANUAL JAM CLEARANCE REQUIRED - SECURE WASTE, PLEASE DISCARD PROPERLY" |
| 705 | CLEAR? |
| 706 | LOGOUT (A) IF (A) IS LOGGED IN |
| 800 | DISPLAY MESSAGE "AUTHORIZED PURGE USER REQUIRED" |
| 801 | LOGIN OF AUTHORIZED OPERATOR (A) |

FIG. 3 CONT.

IMAGE PRODUCING DEVICE WITH SECURITY TO PREVENT DISCLOSURE OF SENSITIVE DOCUMENTS

BACKGROUND OF THE INVENTION

1. Field of the Invention

This invention relates to document security in an image producing device and more specifically, to security against the unintentional purge of sensitive output from a previous copy machine or printer job which purge may provide access to the sensitive output by unauthorized operators.

2. Description of the Related Art

Image producing devices, such as copiers and printers, which possess multiple output destinations such as duplex trays and multiple finisher stations (e.g. stapler or binder stations), present potential information security problems in sensitive installations due to the possibility of leaving extra or unusable output in the machine at the end of a job. Access to such a machine by unauthorized operators should be limited whenever the potential exists for the machine to "purge" out copies or prints left over from some previous job.

Most modern image producing machines possess, at minimum, some form of dedicated internal duplex or multi- purpose intermediate receiver tray to facilitate the production of complex output jobs. In addition, most machines which fall into this category also possess multiple output destinations such as sorters and finishers working together with "sample" (unfinished and unsorted) output trays. Such machines typically possess facilities to automatically clear themselves of or "purge" unusable output left over from some previous job whenever a new job is initiated and some necessary facility of the machine currently contains such unusable output. Examples of necessary machine facilities include the types of intermediate and final output destinations already described.

Also common in such machines is an ability to automatically perform post-jam automatic purges of unusable output from the paper path in order to facilitate efficient single point jam clearance. Although very useful and productive in most customer settings, such forms of automatic purge of waste output from previous jobs may represent a potential compromise of sensitive documents in certain environments. For example, such sensitive material may appear at some future time as part of the waste material being automatically eliminated in the process of running a totally new job with a different operator or in a different job setting.

SUMMARY OF THE INVENTION

Accordingly, it is an object of the present invention to provide an apparatus and method for document security in a copier or printer which overcomes the above-described disadvantages in the prior art.

It is another object of the present invention to provide an apparatus and method for document security in a copier or printer which utilizes a hierarchal access infrastructure based on a particular operator's login password to allow automatic purge of waste documents or electronic data or access to a jammed paper path.

The present invention provides a solution to such potential security breaches that may be incorporated into any image producing device which includes some form of security login procedure. It allows for a hierarchal control of automatic machine purge capability, with facilities to allow for waste output cleanup concurrent with the logout of an operator, and allows for the monitoring of operators who violate security procedures by allowing such waste output to remain in the machine after the completion of their job session.

BRIEF DESCRIPTION OF THE DRAWINGS

These and other objects and advantages of the present invention will become apparent when considered in light of the following detailed description of preferred embodiments taken in conjunction with the accompanying drawings in which:

FIG. 3 shows the steps corresponding to the block diagram of FIG. 2.

DETAILED DESCRIPTION OF PREFERRED EMBODIMENTS

Figure 1A:
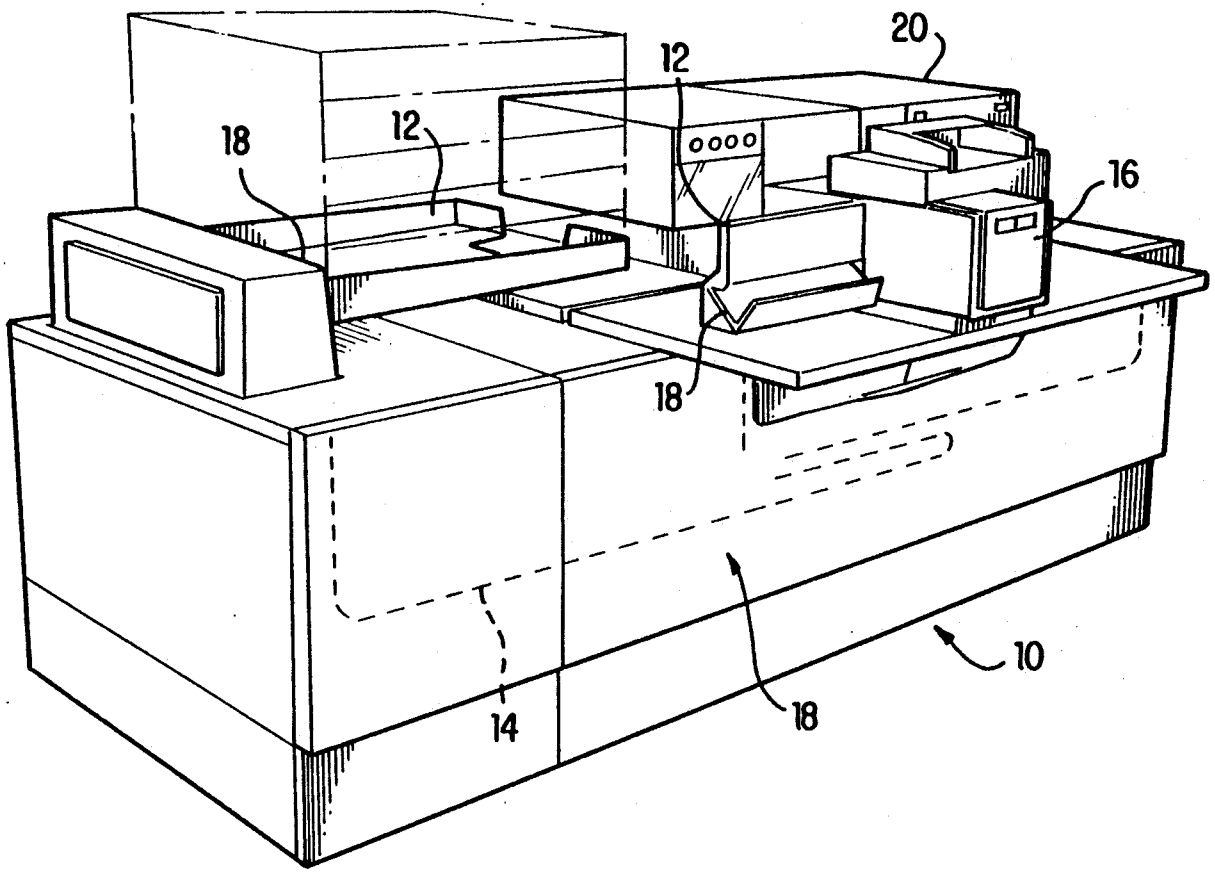
FIG. 1A is a perspective view of an image producing device of the present invention.
Figure 1B:
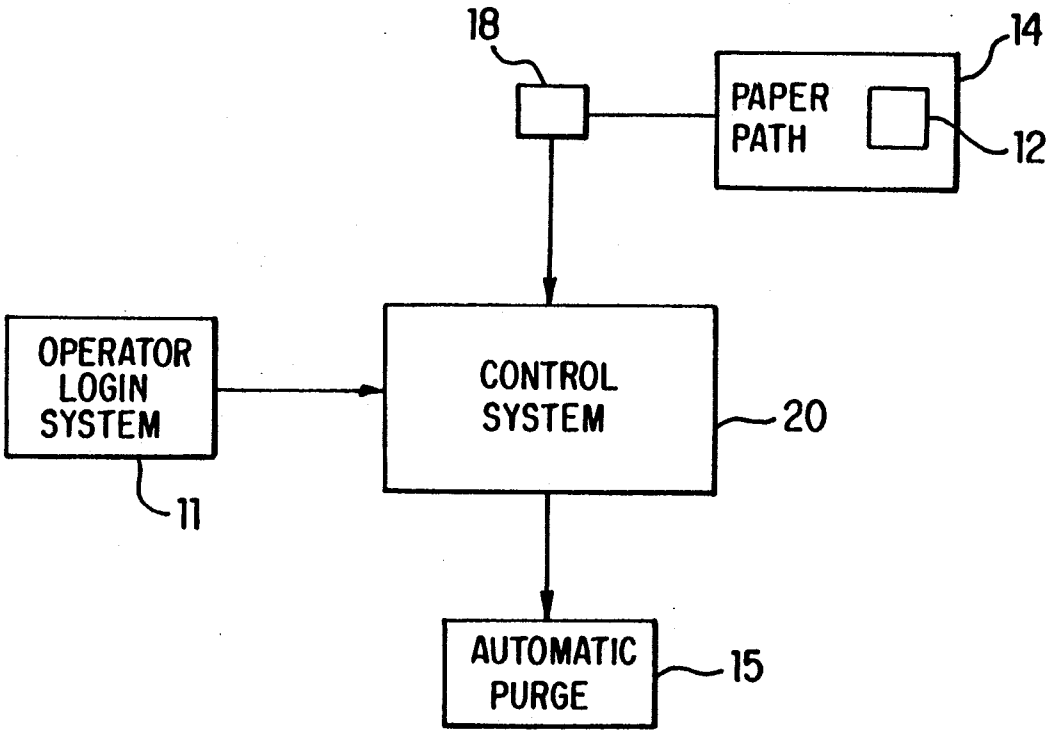
FIG. 1B is a schematic illustration of the interconnection of the elements of the image producing device of FIG. 1A.

Referring to FIGS. 1A and 1B, an appropriate image producing device 10, such as a copier or printer, which may exist in an environment that potentially contains sensitive output information, is generally guarded via some form of operator password login systems 11. Appropriate examples of such operator login systems 11 would be the access control provided by the electronic auditron feature associated with such products as the XEROX 5100, 5090, 1090, etc., where access to machine copy functions is not allowed until an appropriate operator password has been entered and validated, or such printer products as the XEROX 4050 family, where access to machine print buffer functions is disallowed until system administration password protection has been granted. The present invention is described in conjunction with a copy machine 10 for example purposes only and is not meant to be limited thereto. Certainly, any type of image producing device is within the scope of the present invention.

If output from a previous job exists in a finishing device 12 included in the paper path 14 of an image producing device 10, such output can be automatically removed or purged with an automatic purge control 15. Sensors 18 disposed in each finishing device 12 and at specified locations in paper path 14 detect the presence of waste output. A machine control system 20 processes signals from sensors 18 and allows or disallows operation of the image producing device according to the operator's access level. Automatic purge control modification may be implemented based upon an internal site-specific configuration setup (e.g., a service representative NVM setting) to allow selection of either fully automatic purge control (as currently implemented in programs such as the XEROX 5100, etc.) or the alternative purge control strategy suggested by the present invention. This allows for the same basic software package to be installed in all customer sites, whether or not that particular site has a perceived need to protect potentially sensitive information.

The apparatus of the present invention is based on access rights of machine operators. For example, an administrator would have superior access rights thereby enabling complete operation and control of the machine, while a lower level employee may have limited access rights for preventing disclosure to the lower level employee of sensitive documents or electronic images which may have been left in the machine. Approved machine operators (i.e., those assigned access rights into the machine's control system for normal operation or system administration functions) are assigned an appropriate access level with their login password, which supplies four pieces of user information: (1) whether or not this operator's access code allows rights to invoking the automatic purge of waste output from some previous job; (2) whether or not this operator's access code allows rights to inspect an internal history log of what operators have violated document security procedures, and which operators have had purge access to such waste documents; (3) whether or not output generated under this access code should be considered secure; and (4) whether or not this operator has access to a locked output bin.

Figure 2:
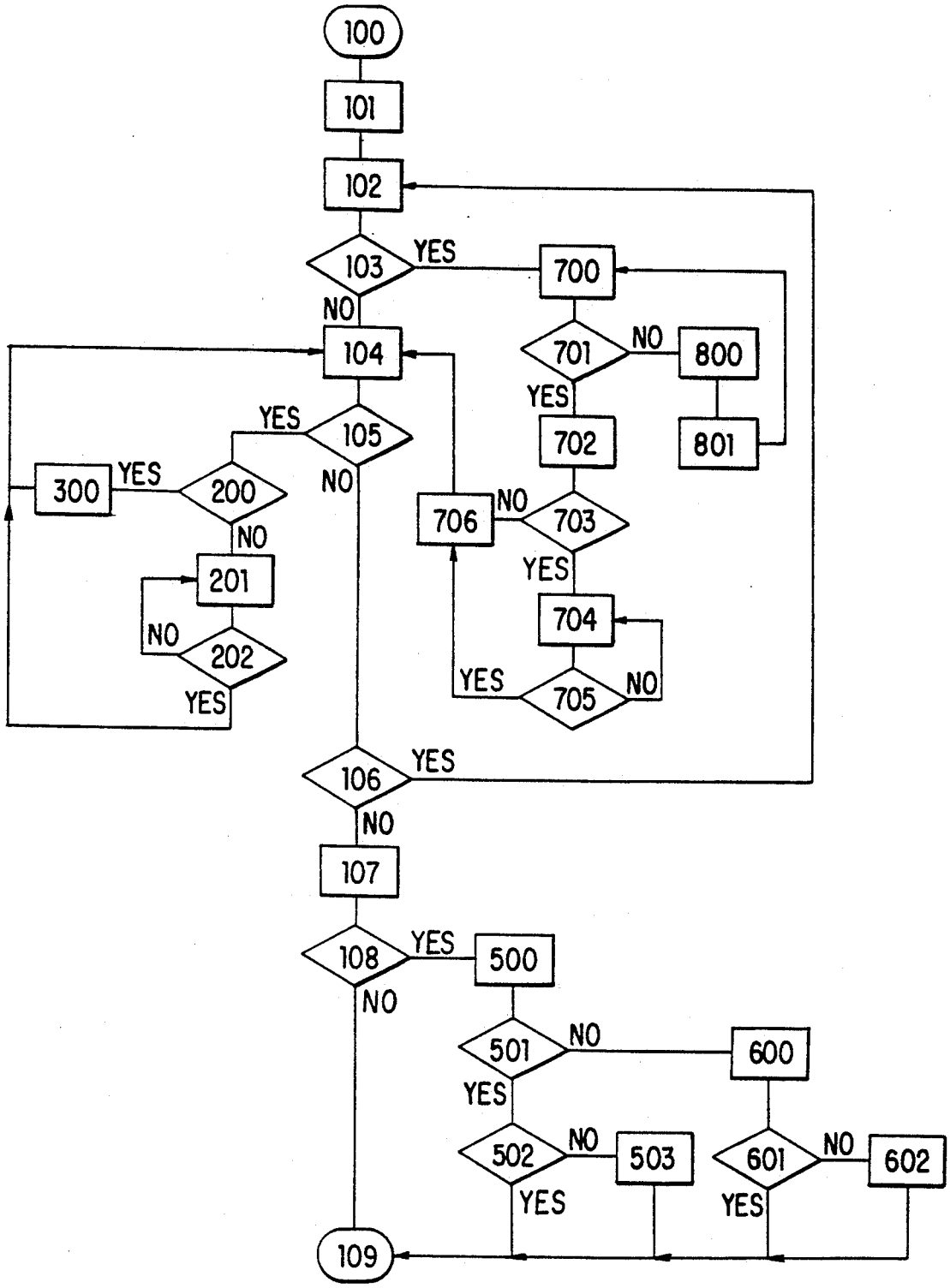
FIG. 2 is a block diagram of the process of the present invention.

Referring to FIGS. 2 and 3, the processing steps of the present invention will now be described. After an operator or systems administrator has logged into the machine, step 100, normal job programming via a display menu and set up are allowed to occur without protected purge control, steps 101–102. However, if the job setup being requested requires the use of a machine facility which currently contains waste copies from a previously secured job (as detected by sensors 18), step 103, normal machine operation (i.e., cycle-up of the job) is disallowed. The system then checks whether the current operator's access level is sufficient to allow an automatic purge of the waste output, steps 700 and 701. If so, automatic purge is performed, step 702, and the system returns (via steps 703–706 described below) to perform the requested job, step 104. If the current operator's access level does not permit an automatic purge of waste material, the system displays a message to that effect, step 800, and prompts the login of an authorized operator (A), step 801. Upon login of the second allegedly authorized operator, the system returns to step 700 and checks their access level. In the event that automatic purge is not available, i.e., a manual jam clearance is required, steps 703–704, the system will not allow operation until the paper path is cleared by an authorized operator, step 705. After such intervention, after the system administrator with purge access control was done performing this maintenance and repair function, the system administrator logs out, step 706, and the machine control system 20 automatically returns to the job setup already initiated by the operator to perform the job at step 104. As a security measure, production of output is not allowed while this hierarchal pair of operators are simultaneously logged into the machine to ensure that the access rights with purge privileges is not mistakenly left active on the machine.

If during their job, any operator experiences a jam or other malfunction, step 105, the machine allows automatic purge of their own waste output to the same final output destination as their main job, steps 200 and 300. Although this contradicts existing machine philosophy of purging unusable output to an external destination not used by the main job, it helps eliminate the leaving of waste output at the machine since it would be difficult to enforce the operator's need to remove such waste material from locations other than their main job output destination. In another embodiment described below, such waste materials are purged to unused output destinations such as a locked internal waste box 16 (see FIG. 1). If the system includes waste box 16, any operator will be allowed to purge secure waste. Access to the waste box, however, would be limited to authorized operators. Still further, authorized operators can be given the choice to purge waste to the waste box or to their final output destination. Such destinations are monitored to ensure operator compliance of waste removal. Similarly, if automatic purge is unavailable, the operator is instructed to clear the paper path, steps 201–202. Due to the nature of the system, access to the paper path requires either an approved operator login or a special key. Once the paper path is clear, the system returns to normal operation, step 104.

At the end of a job, the operator is given the option of programming the setup for another job, or requesting to logout of the system, step 106. If an operator attempts to terminate their session by requesting to logout of the system, step 107 while output information is currently within the machine, step 108 (e.g., during or after a jam or standby condition), the operator is reminded of their responsibility to remove all secured materials from the machine before they are allowed to complete their logout, step 500. When the machine is capable of performing an automatic purge of such waste material, step 501, the operator is presented with the option of cycling up the machine in a purge mode to deliver such remaining output to the final output destination as used with their main job or to the waste box or alternate destination as discussed above, step 502. However, if the operator neglects this task (e.g., they walk away from the machine and their password automatically times out), this security violation is logged against the offending operator access code, step 503 to monitor compliance with policies governing the use of the machine. A systems administrator could then view a list of such delinquent operators to enforce compliance. In addition, if the operator attempts to terminate their session while a manual intervention jam clearance is required, step 600, such that an automatic purge cycle is not possible (i.e., the approved system operator would have to unlock some secured hardware access panel in the machine to manually remove output), it is recommended to have the operator request this jam clearance (step 601) prior to their logout. However, it may be useful to log non-compliance violations, step 602, to non-purgeable jams separately since immediate use of the machine by the next operator would be delayed.

Machine operators with appropriate access rights are allowed to assign operator access controls and examine compliance of each operator access code with the established security procedures. Each job function is issued its own unique access rights, with any machine operator potentially having multiple access codes and privileges.

Service representatives are allowed free and open access to the machine's facilities only after all secured customer output has been removed from the machine using the functions already described. After the service representative has completed service (or if such service access times out under the assumption that the service representative has mistakenly left the machine in this open access mode), service access is terminated automatically. However, if access is again requested and no secured customer output is present in the machine, such access would be granted without further intervention.

To be effective, machines equipped with such a purge security feature require locked access panels covering the entire paper path. Such machines should have unique keys to access their inner paper path components or possess alternative locking mechanisms under the supervision of the machine's access rights control system.

In an alternative embodiment, the image producing device includes a plurality of output bins 12 (shown in phantom in FIG. 1A). Each intended operator has a personal bin which is accessed by the control system through the login procedure. The locking and unlocking of the bin can be controlled by the control system, or alternatively, each operator can access their personal output bin with a key. An operator may designate output as secure via an icon selection or through detection by a software application. When secure output must be purged to an output tray, the system can direct the output to a separate secure bin or waste box 16 which is only accessible by an approved operator.

Although the invention has been described in detail, it will be apparent to those skilled in the art that various modifications may be made without departing from the scope of the invention, which is outlined in the following claims.

We claim:

1. An apparatus for preventing unauthorized disclosures of sensitive information in an image producing device, said apparatus comprising:

means for determining access rights of a first operator, said access rights indicating an access level of said first operator;

sensing means for sensing whether output from a previous job is present in said image producing device;

means for preventing operation of said image producing device in response to signals from said sensing means and said access level of said first operator; and means for inhibiting clearing of said output from a previous job from said image producing device if said access level is less than a predetermined level.

2. An apparatus according to claim 1, wherein said image producing device has a paper path, said sensing means sensing whether outputs from a previous job is present in said paper path.

3. An apparatus according to claim 2, further comprising means for automatically purging said output in said paper path in response to signals from said sensing means and said access level.

4. An apparatus according to claim 3, wherein said means for automatically purging comprises means for directing said output to a waste box.

5. An apparatus according to claim 3, wherein said image producing device comprises a finishing device for finishing output of said image producing device, said means for automatically purging comprising means for directing said output to said finishing device.

6. An apparatus according to claim 3, further comprising means for recording an operator password in response to signals from said sensing means if said operator is logged off and output is present in said paper path.

7. An apparatus according to claim 2, further comprising means for enabling login of a second operator if said means for preventing operation prevents operation of said image producing device because of said access rights level of the first operator.

8. An apparatus according to claim 7, further comprising means for automatically purging said output in said paper path in response to an access level of said second operator.

9. An apparatus according to claim 8, wherein said means for preventing operation of said image producing device prevents operation while both the first and second operators are logged in.

10. An apparatus according to claim 9, wherein said means for preventing operation of said image producing device allows operation if said second operator is logged off and said paper path is clear.

11. An apparatus according to claim 1, wherein said output is electronic image output stored in said image producing device.

12. A method of preventing unauthorized disclosures of sensitive documents in an image producing device having a paper path, said method comprising the steps of:

determining access rights of a first operator, said access rights indicating an access level of said first operator;

sensing whether output from a previous job is present in said paper path;

preventing operation of said image producing device if output is present in said paper path and if said access level is less than a predetermined level; and inhibiting clearing of said output from a previous job from said paper path if said access level is less than said predetermined level.

13. A method according to claim 12, further comprising the step of automatically purging said output in said paper path if said access level is higher than said predetermined level.

14. A method according to claim 13, wherein said automatically purging step comprises the step of directing said output to a waste box.

15. A method according to claim 13, wherein said image producing device comprises a finishing device for finishing output of said image producing device, said automatically purging step comprising the step of directing said output to said finishing device.

16. A method according to claim 13, further comprising the step of recording an operator password if said first operator is logged off and output is present in said paper path.

17. A method according to claim 13, further comprising the step of enabling login of a second operator if the access level of said first operator is less than said predetermined level.

18. A method according to claim 17, further comprising the step of automatically purging said output in said paper path if an access level of said second operator is higher than said predetermined level.

19. A method according to claim 18, further comprising the step of preventing operation of said image producing device while both the first and second operators are logged in.

20. A method according to claim 19, further comprising the step of allowing operation of said image producing device if said second operator is logged off and said paper path is clear.

21. A method of preventing unauthorized disclosures of sensitive information in an image producing device, said method comprising the steps of:

determining access rights of an operator, said access rights indicating an access level of said operator;

sensing whether electronic image output from a previous job is present in said image producing device;

preventing operation of said image producing device if electronic image output is present in said image producing device; and inhibiting clearing of said output from a previous job from said image producing device if said access level is less than a predetermined level.

22. An apparatus for preventing unauthorized disclosures of sensitive information in an image producing device having a plurality of output bins, said apparatus comprising:

means for determining identification information of said operator;

means for determining access rights of said operator;

means for directing said output of said image producing device to a specific one of said plurality of output bins based on said identification information of said operator;

sensing means for sensing whether output from a previous job is present in said image producing device;

means for preventing operation of said image producing device in response to signals from said sensing means and said operator access rights; and means for automatically purging said output from a previous job in said image producing device in response to said signals from said sensing means and said operator access rights, wherein said means for automatically purging comprises means for directing said output to an additional output bin separate from said plurality of output bins.

23. A method of preventing unauthorized disclosures of sensitive information in an image producing device having a plurality of output bins, the method comprising the steps of:

determining identification information of said operator;

determining access rights of said operator;

directing said output of said image producing device to a specific one of said plurality of output bins based on said identification information of said operator;

sensing whether output from a previous job is present in said image producing device;

preventing operation of said imaging producing device in response to signals from said sensing means and said operator access rights; and automatically purging said output from a previous job in said image producing device in response to said signals from said sensing means and said operator access rights, wherein said means for automatically purging comprises means for directing said output to an additional output bin separate from said plurality of output bins.

* * * * *